United States Patent [19]

Katsuki et al.

[11] Patent Number: 4,559,010

[45] Date of Patent: Dec. 17, 1985

[54] APPARATUS FOR PRODUCING OXIDIZED FILAMENTS

[75] Inventors: Kosuke Katsuki; Yukihiro Murakami, both of Ehime, Japan

[73] Assignee: Toray Industries, Inc., Tokyo, Japan

[21] Appl. No.: 603,248

[22] Filed: Apr. 23, 1984

[51] Int. Cl.[4] ..... F27B 9/28

[52] U.S. Cl. ..... 432/59; 432/8; 432/77

[58] Field of Search ..... 432/59, 8, 77, 81, 85

[56] References Cited

U.S. PATENT DOCUMENTS

| | | | |
|---|---|---|---|
| 2,534,973 | 12/1950 | Ipsen et al. | 432/77 |
| 3,385,946 | 5/1968 | Hatchard | 432/8 |
| 3,837,790 | 9/1974 | Pierson | 432/8 |
| 4,364,728 | 12/1982 | Stamp | 432/59 |

*Primary Examiner*—Henry C. Yuen

*Attorney, Agent, or Firm*—Quaintance & Murphy

[57] ABSTRACT

An apparatus for continuously producing continuous oxidized filaments which comprises an oxidizing furnace having a heated oxidizing gas atmosphere therein, into which continuous precursor filaments such as polyacrylaonitle filaments are continuously introduced, in which the precursor filaments are converted into oxidized filaments and from which the oxidized filaments are continuously drawn out, a first duct communicated with the furnace to provide a flow of an oxidizing gas such as heated air having a temperature in the range of from about 200° C. to about 300° C. into the furnace, a second duct communicated with the furnace to exhaust gas from the furnace, a conduit connected to the furnace to draw off a part of gas in the furnace together with sealing air introducing from the outside of the furnace into the furnace, an injecting means provided in the way of the conduit for injecting water in the form of liquid and/or in the form of steam to extinguish the fire in the conduit, a shutting means provided in the way of the conduit to shut a flow of gas in the conduit, and a water spraying means provided in the furnace to extinguish the fire in the furnace.

15 Claims, 14 Drawing Figures

APPARATUS FOR PRODUCING OXIDIZED FILAMENTS

BACKGROUND OF THE INVENTION

1. Field of the Invention

The invention relates generally to apparatus for the oxidation or the stabilization of continuous lengths of organic filamentary material. More specifically, the invention relates to an improved pyrolysis furnace for use in oxidation or stabilization apparatus wherein a continuous length of precursor filamentary material moves through the pyrolysis furnace and a part of gaseous by-products of the pyrolysis process are drawn out from the furnace through a conduit connecting to the body of the furnace and having a shutting means for shutting the movement of gas in the conduit and an injecting means for injecting water in the form of liquid or in the form of steam into the conduit which are operable to put out a fire of burning tar adhering to the inner wall of the conduit. The fire is caused by abnormal burning of filaments in the furnace.

2. Description of the Prior Art

In the past, it has been known to oxidize or stabilize continuous length of organic filamentary material for producing oxidized or stabilized filaments. The oxidized or stabilized filaments are used as fibers which are fireproof fibers to an ordinary match flame. They are also used as reinforcing fibers in slate or concrete board instead of asbestos fibers or as precursor filaments for producing carbon filaments or graphite filaments.

Carbon filaments may be produced by subjecting organic filamentary material such as polyacrylonitrile filaments to specific conditions of temperature and surrounding atmosphere. Thus, in a first stage, the filaments may be heated to a temperature in the range from 200° C. to 300° C. in an oxidizing atmosphere such as air or air enriched with oxygen where upon they are converted into oxidized filaments. In a second stage the oxidized filaments may be heated at a temperature in excess of 1000° C. in an inert atmosphere such as nitrogen. If graphitized filaments are to be produced further heat-treating is necessary which takes place at a temperature which is higher than 2000° C. in an inert atmosphere such as nitrogen.

Recently, production of composite material comprising carbon fibers and resin or carbon fibers and metal became active, and development of mass production process and apparatus for producing oxidized fibers and carbon fibers are demanded.

It is known that in the oxidizing process an oxidizing reaction is carried out and the reaction involves calorification. It is also known that if an abnormal storage of heat occurs on the filaments staying in the furnace, a runaway reaction takes place. It is important to prevent the runaway reaction in the production of the oxidized fibers. Various prior process conditions have been proposed for preventing the runaway reaction, some of which have been practiced in commercial processes.

To satisfy the demand for a mass production process and apparatus, an oxidizing apparatus having a very large output was developed. In the apparatus, the running speed of the filaments passing through the furnace is very high and a large number of filaments are introduced continuously into the furnace at once. The apparatus is designed to prevent the runaway reaction to the extent possible. The process conditions in the oxidizing process in the apparatus are also selected to prevent the runaway reaction to the extent possible. An abnormal running of filaments and a breakage of filaments in the apparatus are sometimes observed. The abnormal running of the filaments or the breakage of the filaments is one of the causes of the runaway reaction. If the apparatus has filaments guiding rollers within the treating chamber, a coiling of the filament around the roller, caused by the breakage of the filament is too apt to occur causing the runaway reaction. In the large scale oxidizing furnace there are a great many causes of the runaway reaction compared to the conventional small scale oxidizing furnace, because the speed of the running filaments in the large scale oxidizing furnace is very high and the number of filaments also very large. On the other hand, a large amount of gaseous by-products come from the oxidizing compared to the conventional small scale furnace and are drawn out from the body of the furnace through a conduit connected to the body. The by-products are mainly decomposition products of the filaments such as HCN, CO and decomposition products of an oiling agent on the filaments. The by-products include tar-like substance. This tar-like substance exists in the vapor state at temperatures of more than about 200° C. At temperature lower than about 200° C., the vapor condenses quickly and becomes the so called tar. If the conduit for extracting the gaseous by-products is not separately heated, then much of the tar adheres to the inner wall of the conduit. The quantity of adhered tar observed in the large scale oxidizing furnace is very large compared to the conventional small scale oxidizing furnace. Thus, once the runaway reaction happens in the body of the large scale oxidizing furnace, the tar adhering to the conduit catches fire. The fire rapidly spreads along the length of the conduit. The fire damages the apparatus and causes pollution problems. Reducing the damage and solving the problem of pollution is a serious problem for a person who has control over the large scale oxidizing furnace.

SUMMARY OF THE INVENTION

It should now be apparent that there exists a need for an oxidizing furnace which overcomes problems of the type noted above.

It is therefore a general object of the invention to provide an apparatus for producing continuous oxidized filaments which overcomes problems mentioned heretofore.

A more specific object of the invention is to provide an apparatus for producing continuous oxidized filaments, which apparatus is suitable for mass production of the oxidized filaments.

An apparatus for continuously producing continuous oxidized filaments according to the present invention includes a furnace having a heated oxidizing gas atmosphere therein, into which continuous precursor filaments are continuously introduced, in which the precursor filaments are converted into the oxidized filaments and from which the oxidized filaments are continuously drawn out, an inlet provided at the furnace for introducing the precursor filaments into the furnace, an outlet provided at the furnace for drawing out the oxidized filaments from the furnace, a treating chamber provided in the furnace for oxidizing the filaments, a gas introduction chamber provided in the furnace at the outside of the treating chamber for introducing the heated oxidizing gas into the treating chamber, a gas exhaust chamber provided in the furnace at the outside of the treating chamber and the opposite side of the gas introduction chamber for drawing off a major part of the gas from the treating chamber, a sealing gas exhaust chamber provided in the furnace at the outside of the gas introduction chamber and the opposite side of the treating chamber for drawing off a part of the gas from the treating chamber and air introducing into the furnace from the outside thereof, a first duct connected to the gas introduction chamber to provide positively a flow of the heated oxidizing gas into the gas introduction chamber, a second duct connected to the gas exhaust chamber to provide positively a flow of the gas from the gas exhaust chamber, a conduit connected to the sealing gas exhaust chamber to provide positively a flow of the gas from the sealing gas exhaust chamber, an injecting means communicated with the conduit for injecting water into the conduit, and a shutting means provided in the conduit for shutting the flow of the gas in the conduit.

In the apparatus when the water injected into the conduit is in the form of liquid, it is good for rapid decreasing the temperature in the conduit and when the water injected into the conduit is in the form of steam, it is good for giving suffocative action to the fire in the conduit. It is preferable that the apparatus has a water injecting means in the treating chamber for injecting water in the treating chamber. It is preferable that a yarn breakage detecting means is provided in the apparatus at a path of the filaments between the inlet and outlet of the filaments and further an alarming means responsive to the yarn breakage detecting means is provided in the apparatus for indicating that a yarn breakage happens in the furnace. It is further preferable that a circulating duct is provided in the apparatus between the first duct and the second duct to return at least a portion of the gas from the second duct to the first duct to obtain an economical operation of the apparatus. In the apparatus, heated air having a temperature in the range of from about 200° C. to about 300° C. may be fed into the furnace through the first duct to provide the heated oxidizing atmosphere in the treating chamber. Under these conditions the precursor filaments made of polyacrylonitrile filaments are preferably treated, and the filaments are converted into the oxidized filaments.

In this specification, the expression "polyacrylonitrile" relates to homopolymers of acrylonitrile and copolymers containing at least 80 percent of acrylonitrile units.

BRIEF DESCRIPTION OF THE DRAWINGS

The above and other objects of the present invention will be apparent to thoses skilled in the art when this specification is read in conjunction with the appended drawings wherein like reference numerals have been applied to like elements and wherein.

DETAILED DESCRIPTION OF THE PREFERRED EMBODIMENT

Figure 1:
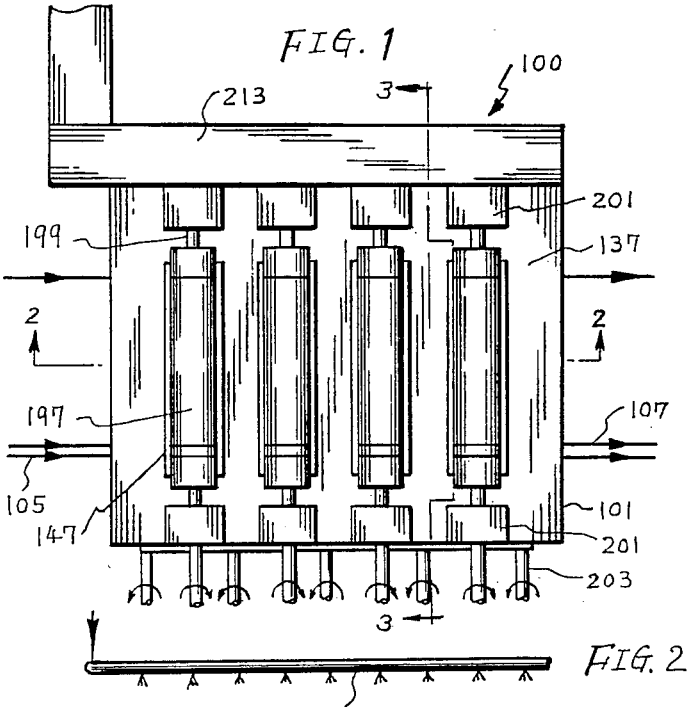
FIG. 1 is a schematic illustration of a plan view of a preferred embodiment of the invention.
Figure 2:
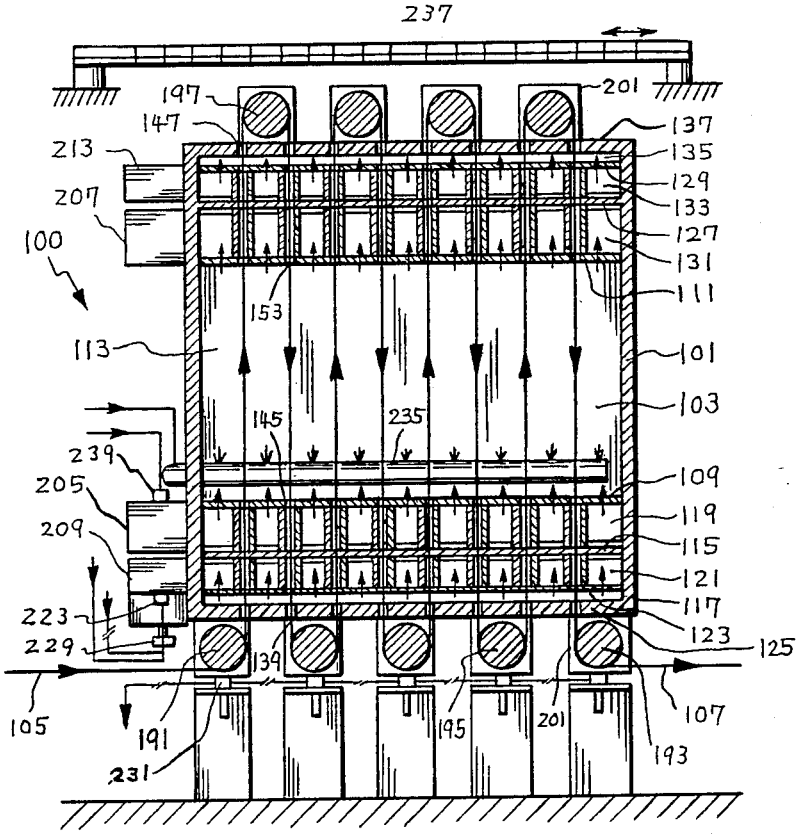
FIG. 2 is a vertical sectional view taken substantially along line 2—2 of FIG. 1.
Figure 3:
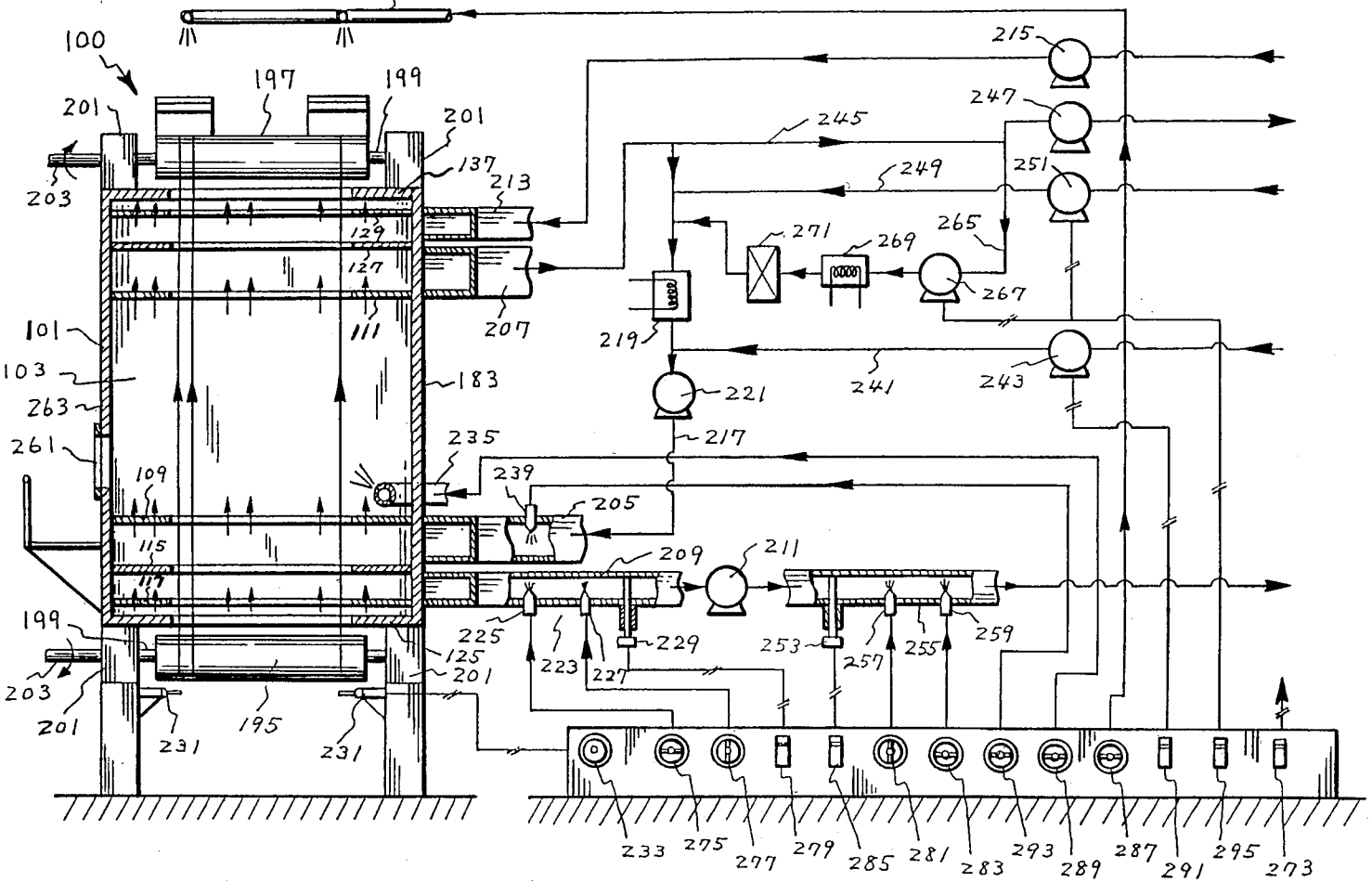
FIG. 3 is a vertical cross-sectional view taken on line 3—3 of FIG. 1.
Figure 4:
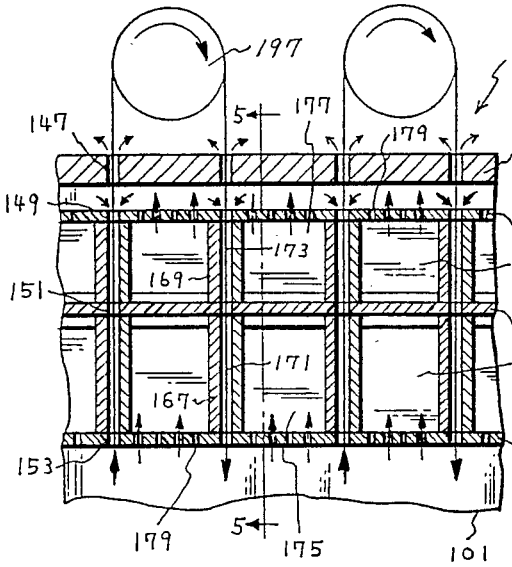
FIG. 4 is an enlarged vertical sectional portion of the upper part of the apparatus illustrated in FIG. 2.
Figure 5:
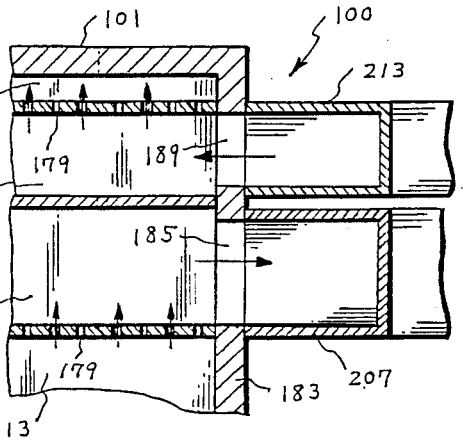
FIG. 5 is a vertical cross-sectional view taken along line 5—5 of FIG. 4.
Figure 6:
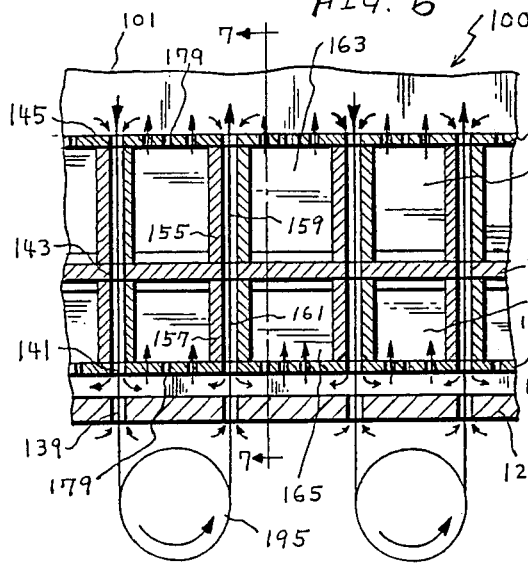
FIG. 6 is an enlarged vertical sectional portion of the lower part of the apparatus illustrated in FIG. 2.
Figure 7:
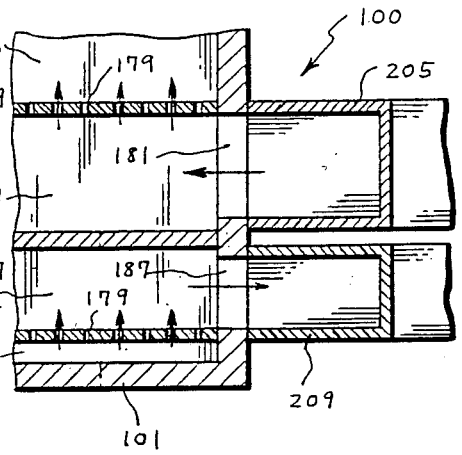
FIG. 7 is a vertical cross-sectional view taken along line 7—7 of FIG. 6.

Turning now to FIGS. 1, 2, 3, 4, 5, 6 and 7, there is shown an embodiment of the present invention, namely an apparatus 100 for producing oxidized filaments. In those figures, the apparatus 100 for continuously producing continuous oxidized filaments comprises a furnace 101 having a heated oxidizing gas atmosphere 103 comprising air having a temperature in the range of from about 200° C. to about 300° C. therein, into which continuous precursor filaments 105 made of continuous polyacrylonitrile filaments are continuously introduced, in which the precursor filaments 105 are converted into oxidized filaments 107 during passing through the atmosphere 103 and from which the oxidized filaments 107 are continuously drawn out. In the furnace 101, a first lower partition wall 109 is provided at a lower portion in the furnace 101 and a first upper partition wall 111 is provided at an upper portion in the furnace 101 so that a treating chamber 113 providing the heated oxidizing gas atmosphere 103 is formed between the first lower partition wall 109 and the first upper partition wall 111. Further, a second lower partition wall 115 is provided in the furnace 101 at below the first lower partition wall 109 and a third lower partition wall 117 is provided in the furnace 101 below the second lower partition wall 115 so that a gas introduction chamber 119 is formed between the first lower partition wall 109 and the second lower partition wall 115, so that a sealing gas exhaust chamber 121 is formed between the second lower partition wall 115 and the third lower partition wall 117, and so that a lower room 123 is formed between the third lower partition wall 117 and the bottom wall 125 of the furnace 101. Still further, a second upper partition wall 127 is provided in the furnace 101 above the first upper partition wall 111 and a third upper partition wall 129 is provided in the furnace 101 above the second upper partition wall 127 so that a gas exhaust chamber 131 is formed between the first upper partition wall 111 and the second upper partition wall 127, so that a sealing gas introduction chamber 133 is formed between the second upper partition wall 127 and the third upper partition wall 129, and so that an upper room 135 is formed between the third upper partition wall 129 and the top wall 137 of the furnace 101.

A series of lower slits 139, 141, 143 and 145 are provided at the bottom wall 125 of the furnace 101, the third lower partition wall 117, the second lower partition wall 115 and the first lower partition wall 109 respectively through which the filaments pass, and a series of upper slits 147, 149, 151 and 153 are provided at the top wall 137 of the furnace 101, the third upper partition wall 129, the second upper partition wall 127 and the first upper partition wall 111 respectively through which the filaments pass.

A series of lower sub-partition walls 155 and 157 are provided between the first lower partition wall 109 and the second lower partition wall 115, and the second lower partition wall 115 and the third lower partition wall 117 along both sides of the lower slits 141, 143 and 145 respectively so that a series of lower yarn passing conduits 159 and 161 connecting between the lower room 123 and the treating chamber 113 is formed, so that a series of sub-gas introduction chambers 168 is formed in the gas introduction chamber 119 and so that a series of sub-sealing gas exhaust chambers 165 is formed in the sealing gas exhaust chamber 121. A series of upper sub-partition walls 167 and 169 are provided between the first upper partition wall 111 and the second upper partition wall 127, and the second upper partition wall 127 and the third upper partition wall 129 along both sides of the upper slits 149, 151 and 153 respectively so that a series of upper yarn passing conduits 171 and 173 connecting between the upper room 135 and the treating chamber 113 is formed, so that a series of sub-gas exhaust chambers 175 is formed in the gas exhaust chamber 131 and so that a series of sub-sealing gas introduction chambers 177 is formed in the sealing gas introduction chamber 133. Each of the first lower partition wall 109, the third lower partition wall 117, the first upper partition wall 111 and the third upper partition wall 129 has perforations 179.

A series of sub-gas inlets 181 is provided at a lengthwise side wall 183 of the furnace 101 at the position corresponding to the sub-gas introduction chambers 163, and a series of sub-gas outlets 185 is provided at a lengthwise side wall 183 of the furnace 101 at the position corresponding to the sub-gas exhaust chambers 175. A series of sub-sealing gas outlets 187 is provided at a lengthwise side wall 183 of the furnace 101 at the position corresponding to the sub-sealing gas exhaust chambers 165, and a series of sub-sealing gas inlets 189 is provided at a lengthwise side wall 183 of the furnace 101 at the position corresponding to the sub-sealing gas introduction chambers 177.

An inlet guide roller 191 is provided outside the furnace 101 and at a position corresponding to one of the outermost slits of the lower slits 139, to guide the filaments 105 into the furnace 101. An outlet guide roller 193 is provided outside the furnace 101 and at a position corresponding to the other outermost slit of the lower slits 139, to guide the filaments 107 from the furnace 101. A series of lower guide rollers 195 is provided outside the bottom wall 125 of the furnace 101 and at alternate positions midway between adjacent pairs of slits in the lower slits 139. A series of upper guide rollers 197 is provided outside the top wall 137 of the furnace 101 and at offset alternate positions midway between adjacent pairs of slits in the upper slits 147.

A shaft 199 supported rotatably by bearings 201 is provided to each of the inlet guide roller 191, the outlet guide roller 193, the lower guide rollers 195 and the upper guide rollers 197. Each of the shafts 199 is communicated with a drive station (not shown) via a driving shaft 203 connected to the shaft 199 to positively rotate the guide rollers 191, 193, 195 and 197.

A first duct 205 is provided in fluid communication with the sub-gas inlets 181 to provide positively a continuous flow of heated air having a temperature in the range of from about 200° C. to about 300° C. into the treating chamber 113 of the furnace 101 through the sub-gas inlets 181, the sub-gas introduction chambers 163 and the perforations 179 provided at the first lower partition wall 109. A second duct 207 is provided in fluid communication with the sub-gas outlets 185 to provide positively a continuous flow of a major part of the gas from the treating chamber 113 of the furnace 101 through the perforations 179 provided at the first upper partition wall 111, the sub-gas exhaust chambers 175 and the sub-gas outlets 185.

A first conduit 209 is provided in fluid communication with the sub-sealing gas outlets 187 to provide positively a continuous flow of a part of the gas flown out from the treating chamber 113 through the lower yarn passing conduits 159 and 161 into the lower room 123 and air introduced into the lower room 123 from the lower slits 139 provided at the bottom wall 125 of the furnace 101, through the lower room 123, the perforations 179 provided at the third lower partition wall 117, the sub-sealing gas exhaust chambers 165 and the sub-sealing gas outlets 187. A gas exhausting means 211 comprising a blower is interposed in the way of the first conduit 209, to draw off the gas from the sub-sealing gas exhaust chambers 165.

A second conduit 213 is provided in fluid communication with the sub-sealing gas inlets 189 to provide positively a continuous flow of air into the upper yarn passing conduits 173 and 171 and the upper slits 147 provided at the top wall 137 of the furnace 101 through the sub-sealing gas inlets 189, sub-sealing gas introduction chambers 177, the perforations 179 provided at the third upper partition wall 129 and the upper room 135. An air feeding means 215 comprising a blower is interposed in the way of the second conduit 213 to feed air into the sub-sealing gas introduction chambers 177.

A circulating duct 217 is provided in fluid communication with the second duct 207 and the first duct 205, to return at least a portion of the gas from the second duct 207 to the first duct 205. A gas heating means 219 is interposed in the way of the circulating duct 217, and a gas feeding means 221 comprising a blower is interposed in the way of the circulating duct 217 at the downstream of the gas heating means 219 to feed at least a portion of the gas from the sub-gas exhaust chambers 175 to the sub-gas introduction chambers 163.

An injecting means 223 is communicated with the first conduit 209 to inject water into the first conduit 223. In this embodiment, the injecting means comprises an injecting means 225 for water in the form of liquid and an injecting means 227 for water in the form of steam. A shutting means 229 is provided in the first conduit 209 at the downstream of the injecting means 225 and 227 for shutting the flow of gas in the first conduit 209.

A series of yarn breakage detecting means 231 is provided below the lower guide rollers 195, and an alarming means 233 is provided to response to the yarn breakage detecting means 231.

It is preferable in the apparatus 100 that a water spraying means 225 is provided in the treating chamber 113 to spray water in the form of liquid. Further it is preferable in the apparatus 100 that a water spraying means 237 is provided above the series of upper guide rollers 197 to spray water in the form of liquid into the furnace 101 through the upper slits 147. Still further it is preferable in the apparatus 100 that an atomized water injecting means 239 is provided in the first duct 205 to inject water in the form of atomized liquid into the first duct 205.

It is preferable in the apparatus 100 that an air feeding conduit 241 is connected to the circulating duct 217 at a position between the gas heating means 219 and the gas feeding means 221 to provide air into the circulating duct 217, and an air feeding means 243 comprising a blower is provided in the way of the air feeding conduit 241 to feed air not positively heated into the circulating duct 217. It is also preferable in the apparatus 100 that a gas exhausting conduit 245 is connected to the circulating duct 217 at the upstream of the gas heating means 219, a gas exhausting means 247 comprising a blower is interposed in the way of the gas exhausting conduit 245 to draw off a part of the gas in the circulating duct 217, an air feeding conduit 249 is connected to the circulating duct 217 at a position between the connecting position of the gas exhausting conduit 245 and the gas heating means 219 and an air feeding means 251 comprising a blower is interposed in the way of the air feeding conduit 249 to feed air into the circulating duct 217. It is further preferable in the apparatus 100 that the shutting means 229 is provided at the downstream of the injecting means 223 and at the upstream of the gas exhausting means 211, and another shutting means 253 is provided in the first conduit 209 at the downstream of the gas exhausting means 211 and another injecting means 255 to inject water into the first conduit 217 is communicated with the first conduit 217 at the downstream of the latter shutting means 253. The injecting means 255 may comprise an injecting means 257 for injecting water in the form of liquid and an injecting means 259 for injecting water in the form of steam. It is still further preferable in the apparatus 100 that peep windows 261 are provided on a lengthwise side wall 263 of the furnace 101 to be seen and checked conditions in the furnace 101 by an operator.

It is preferable in the apparatus 100 that a sub-circulating duct 265 is provided to the circulating duct 217 at the upstream of the gas heating means 219, and a gas feeding means 267 comprising a blower, a gas heating means 269 and a gas treating station 271 are interposed respectively in the way of the sub-circulating duct 265.

The operation of the apparatus 100 shown in FIGS. 1 to 7 will be explain next. In response to information relating to breakage of the filaments given by the alarming means 233, or an abnormal running of the filaments or a fire in the furnace 101, an operator will check the status in the furnace 101 by peeping through one of the peep windows 261. When the operator observes that a fire may occur or that a fire has already occurred in the furnace 101, operator acts to operate a main switch 273 to stop the feeding of the filaments 105 to the furnace 101. Where the operator observed that a fire has already spread into the first conduit 209, the operator decides under the standard operating manual whether it is necessary to start to inject water in the form of liquid and/or steam into the first conduit 209 by operating a valve 275 and/or a valve 277 communicated with the injecting means 225 and the injecting means 227, and/or to shut the flow of gas in the first conduit 209 by operating a switch 279 communicated with the shutting means 229 to shut the first conduit 209, and further whether it is necessary to start to inject water in the form of liquid and/or steam into the first conduit 209 by operating a valve 281 and/or a valve 283 communicated with the injecting means 257 and the injecting means 259, and/or shut the first conduit 209 by operating a switch 285 communicated with the shutting means 253 to shut the first conduit 209. Where the operator observes that a fire may occur or that a fire has already occurred in the furnace 101, the operator decides under the standard operating manual whether it is necessary to start to inject water into the furnace from the water spraying means by operating a valve 287 and/or to start to inject water in the treating chamber 113 from the water spraying means 235 by operating a valve 289. And also the operator decides whether it is necessary to start to feed non-heated air into the circulating duct 217 from the air feeding conduit 241 by operating a switch 291 and/or to feed automized water into the first duct 205 by operating a valve 293, and on that time the operator also decides whether it is necessary to stop the air feeding means 251 and the gas feeding means 267 by operating a switch 295.

In the apparatus 100, an automatic operating system including a computer may be introduced. The automatic operating system may comprises a system to feed a signal produced from the yarn breakage detecting means 231 and/or a signal produced by a temperature detecting means (not shown) provided in the treating chamber 113 to a computer having a function to compare a standard condition and an abnormal condition detected by the detecting means, and to feed a signal produced from the computer to the corresponding valves 275, 277, 281, 283, 293, 289 and 287, and switches 279, 285, 291, 295 and 273.

Figure 8:
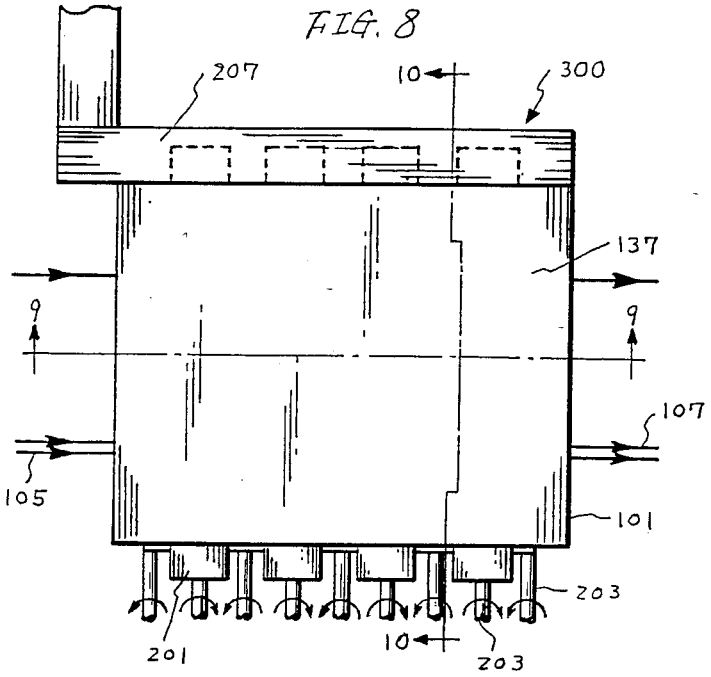
FIG. 8 is a schematic illustration of a plan view of another preferred embodiment of the invention.
Figure 9:
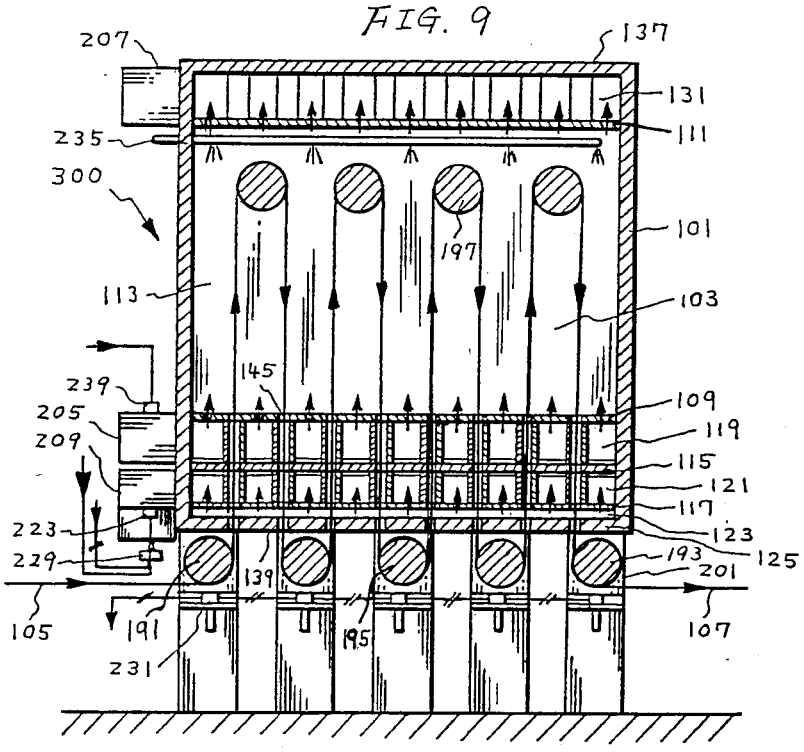
FIG. 9 is a vertical sectional view taken substantially along line 9—9 of FIG. 8.
Figure 10:
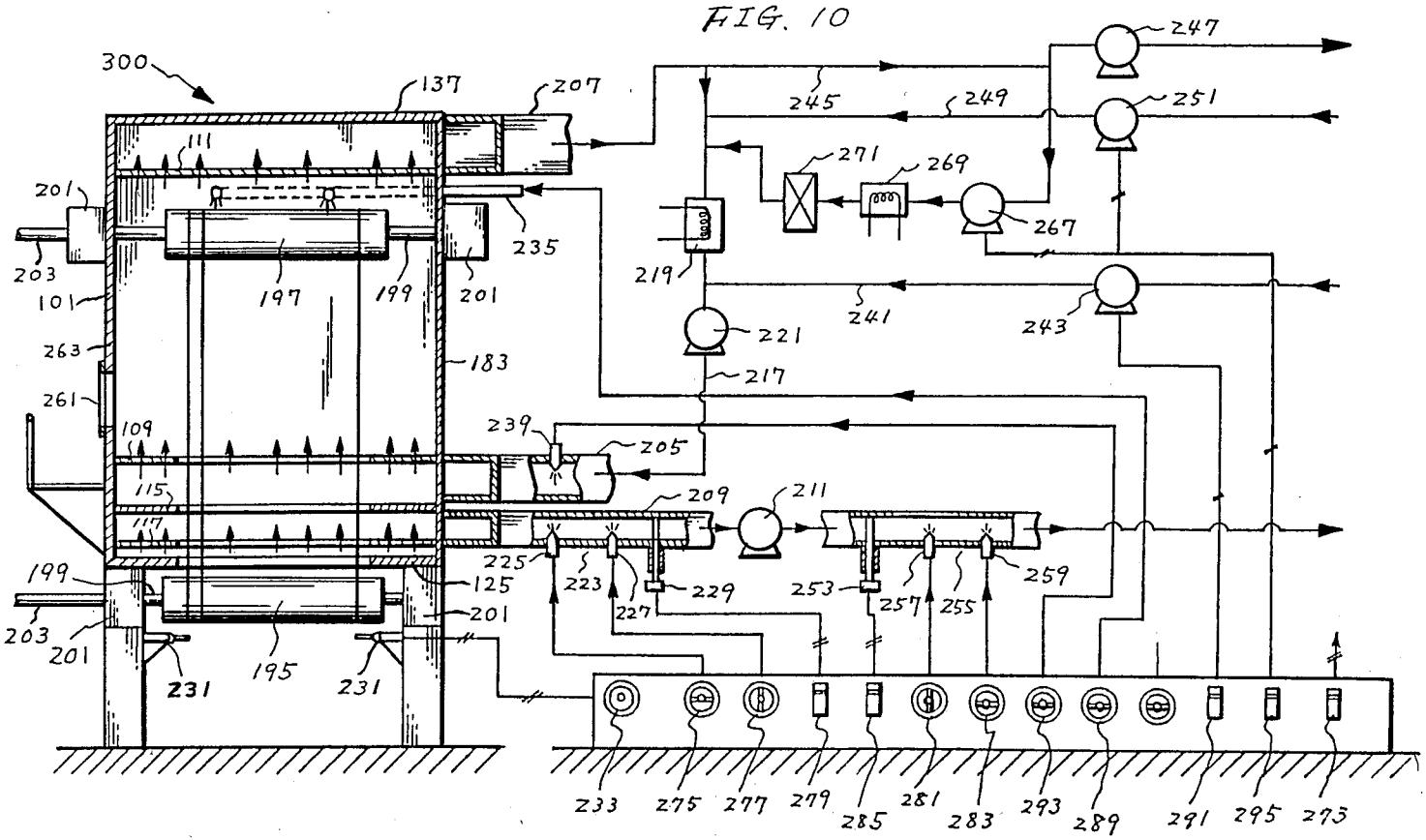
FIG. 10 is a vertical cross-sectional view taken on line 10—10 of FIG. 8.
Figure 11:
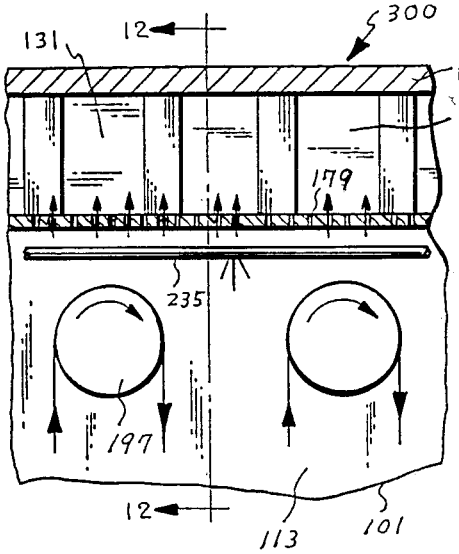
FIG. 11 is an enlarged vertical sectional portion of the upper part of the apparatus illustrated in FIG. 9.
Figure 12:
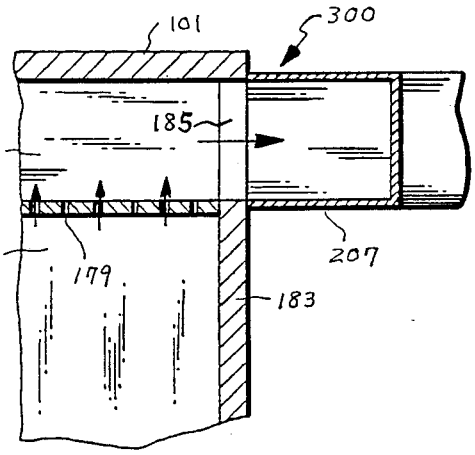
FIG. 12 is a vertical cross-sectional view taken along line 12—12 of FIG. 11.
Figure 13:
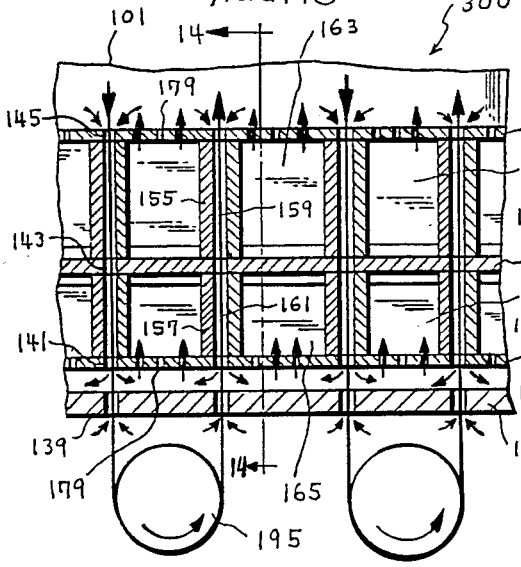
FIG. 13 is an enlarged vertical sectional portion of the lower part of the apparatus illustrated in FIG. 9.
Figure 14:
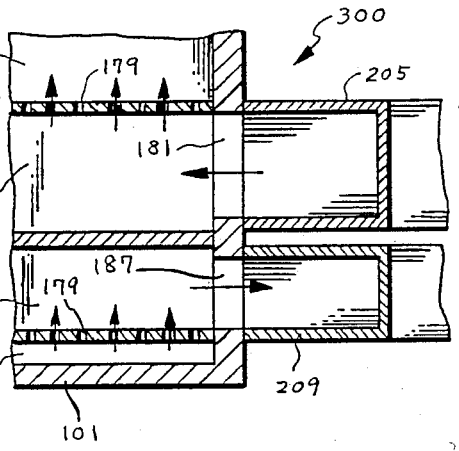
FIG. 14 is a vertical cross-sectional view taken along line 14—14 of FIG. 13.

Another embodiment of the present invention in the form of the apparatus 300 is illustrated in FIGS. 8, 9, 10, 11, 12, 13 and 14. This second embodiment has five significant differences from the first embodiment previously described.

The first difference is that the series of upper guide rollers 197 is provided outside the furnace 101 in the first embodiment namely apparatus 100, but in the second embodiment namely apparatus 300, a series of upper guide rollers 197 is provided upper portion in a furnace 101.

The second difference is that the apparatus 100 has the upper room 135, the third upper partition wall 129, the sealing gas introduction chamber 133, the series of sub-partition wall 169, the series of sub-sealing gas inlets 198 and the second conduit 213, but the apparatus 300 has not those elements, since the series of upper guide rollers are placed inside the furnace 101 and the top of the furnace 101 is completely covered with the top wall 137.

The fourth difference is that the apparatus 100 has the gas exhaust chamber 131 separated into the series of sub-gas exhaust chambers 175 between the first upper partition wall 111 and the second upper partition wall 127, but the apparatus 300 has a gas exhaust chamber 131 between a first upper partition wall 111 and the top wall 137 of the furnace 101 without such a series of sub-gas exhaust chambers.

The fifth difference is that the apparatus 100 has the water spraying means 237 above the furnace 101 and the water water spraying means 235 at a lower portion of the treating chamber 113, but the apparatus 300 has not a water spraying means above the furnace 101 and has a water spraying means 235 provided in the treating chamber 113 between the series of upper guide rollers 197 and the first upper partition wall 111.

What is claimed is:

1. An apparatus for continuously producing continuous oxidized filaments, which comprises:

(a) a furnace having a heated oxidizing gas atmosphere therein, into which continuous precursor filaments are continuously introduced, in which the precursor filaments are converted into the oxidized filaments and from which the oxidized filaments are continuously drawn out, (b) an inlet provided at the furnace, for introducing the precursor filaments into the furnace, (c) an outlet provided at the furnace, for drawing out the oxidized filaments from the furnace, (d) a treating chamber provided in the furnace, for oxidizing the filaments, (e) a gas introduction chamber provided in the furnace at the outside of the treating chamber, for introducing the heated oxidizing gas into the treating chamber, (f) a gas exhaust chamber provided in the furnace at the outside of the treating chamber and the opposite side of the gas introduction chamber, for drawing off a major part of the gas from the treating chamber, (g) a sealing gas exhaust chamber provided in the furnace at the outside of the gas introduction chamber and the opposite side of the treating chamber, for drawing off a part of the gas from the treating chamber and air introducing into the furnace from the outside thereof, (h) a first duct connected to the gas introduction chamber, to provide positively a flow of the heated oxidizing gas into the gas introduction chamber, (i) a second duct connected to the gas exhaust chamber, to provide positively a flow of the gas from the gas exhaust chamber, (j) a conduit connected to the sealing gas exhaust chamber, to provide positively a flow of the gas from the sealing gas exhaust chamber, (k) an injecting means communicated with the conduit, for injecting water into the conduit, and (l) a shutting means provided in the conduit, for shutting the flow of the gas in the conduit.

2. The apparatus of claim 1 wherein the water is in the form of liquid.

3. The apparatus of claim 1 wherein the water is in the form of steam.

4. The apparatus of claim 1 wherein a water injecting means is provided in the treating chamber, for injecting water in the treating chamber.

5. The apparatus of claim 1 wherein a yarn breakage detecting means is provided at a path of the filaments between the inlet and outlet of the filaments, and an alarming means responsive to the yarn breakage detecting means is provided for indicating that a yarn breakage happens in the furnace.

6. The apparatus of claim 1 wherein a circulating duct is provided between the first duct and the second duct, to return at least a portion of the gas from the second duct to the first duct.

7. The apparatus of claim 1 wherein air having a temperature in the range of from about 200° C. to about 300° C. is used as the heated oxidizing gas, and polyacrylonitrile filaments are used as the precursor filaments.

8. An apparatus for continuously producing continuous oxidized filaments, which comprises:

(a) a furnace having a heated oxidizing gas atmosphere therein, into which continuous precursor filaments are continuously introduced, in which the precursor filaments are converted into the oxidized filaments by passing the filaments through the atmosphere and from which the oxidized filaments are continuously drawn out, (b) a first lower partition wall provided at a lower portion in the furnace and an upper partition wall provided at an upper portion in the furnace so that a treating chamber providing the heated oxidizing gas atmosphere is formed between the first lower partition wall and the upper partition wall and so that a gas exhaust chamber is formed between the upper partition wall and the top wall of the furnace, (c-1) a second lower partition wall provided in the furnace at below the first lower partition wall, (c-2) a third lower partition wall provided in the furnace below the second lower partition wall so that a room is formed between the third lower partition wall and the bottom wall of the furnace, (d) a series of slits provided at the bottom wall of the furnace, the third lower partition wall, the second lower partition wall and the first lower partition wall respectively through which the filaments pass, (e) a series of sub-partition walls provided between the first lower partition wall and the second lower partition wall, and the second lower partition wall and the third lower partition wall along both sides of the slits respectively so that a series of yarn passing conduits connecting between the room and the treating chamber is formed, so that a series of sub-gas introduction chambers is formed and so that a series of sub-sealing gas exhaust chambers is formed, (f) perforations provided at the first lower partition wall, the third lower partition wall and the upper partition wall, (g-1) a series of sub-gas inlets provided at a lengthwise side wall of the furnace at the position corresponding to the sub-gas introduction chambers, (g-2) a gas outlet provided at a lengthwise side wall of the furnace at the position corresponding to the gas exhaust chamber, (h) a series of sub-sealing gas outlets provided at a lengthwise side wall of the furnace at the position corresponding to the sub-sealing gas exhaust chambers, (i-1) an inlet guide roller provided outside the furnace and at a position corresponding to one of the outermost slits of the series of slits, to guide the filaments into the furnace, (i-2) an outlet guide roller provided outside the furnace and at a position corresponding to the other outermost slit of the series of slits, to guide the filaments from the furnace, (i-3) a series of lower guide rollers provided outside the bottom wall of the furnace and at alternate positions midway between adjacent pairs of slits in the slits, (i-4) a series of upper guide rollers provided inside the furnace and at offset alternate positions midway between adjacent pairs of slits in slits, (j-1) a first duct provided in fluid communication with the sub-gas inlets, to provide positively a flow of the heated oxidizing gas into the treating chamber, (j-2) a second duct provided in fluid communication with the gas outlet, to provide positively a flow of a major part of the gas from the treating chamber, (k-1) a conduit provided in fluid communication with the sub-sealing gas outlets, to provide positively a flow of a part of the gas flown out from the treating chamber through the yarn passing conduits into the room and air introduced into the room through the slits provided at the bottom wall of the furnace, (k-2) a gas exhausting means interposed in the way of the conduit, to draw off the gas from the sub-sealing gas exhaust chambers, (l-1) a circulating duct provided in fluid communication with the second duct and the first duct, to return at least a portion of the gas from the second duct to the first duct, (l-2) a gas heating means interposed in the way of the circulating duct, (l-3) a gas feeding means interposed in the way of the circulating duct at the downstream of the gas heating means, to feed at least a portion of the gas from the gas exhaust chamber to the sub-gas introduction chambers, (m-1) an injecting means communicated with the conduit, for injecting water into the conduit, (m-2) a shutting means provided in the conduit, for shutting the flow of gas in the conduit, (n) a series of yarn breakage detecting means provided below the lower guide rollers, and (o) an alarming means provided to response to the yarn breakage detecting means.

9. The apparatus of claim 8 wherein the water injected into the first conduit is in the form of liquid

10. The apparatus of claim 8 wherein the water injected into the first conduit is in the form of steam.

11. The apparatus of claim 8 wherein a water spraying means is provided in the treating chamber, to spray water in the form of liquid.

12. The apparatus of claim 8 wherein an atomized water injecting means is provided in the first duct, to inject water in the form of atomized liquid into the first duct.

13. The apparatus of claim 8 wherein an air feeding conduit is connected to the circulating duct at a position between the gas heating means and the gas feeding means, to provide air into the circulating duct and an air feeding means is provided in the way of the air feeding conduit, to feed air not positively heated into the circulating duct.

14. The apparatus of claim 8 wherein a gas exhausting conduit is connected to the circulating duct at the upstream of the gas heating means, a gas exhausting means is interposed in the way of the gas exhausting conduit, to draw off a part of the gas in the circulating duct, an air feeding conduit is connected to the circulating duct at a position between the connecting position of the gas exhausting conduit and the gas heating means and an air feeding means are interposed in the way of the air feeding conduit, to feed air into the circulating duct.

15. The apparatus of claim 8 wherein the shutting means is provided at the downstream of the injecting means and at the upstream of the gas exhausting means, and another shutting means is provided in the conduit at the downstream of the gas exhausting means and another injecting means is communicated with the conduit at the downstream of the latter shutting means.

* * * * *